US006148894A

United States Patent [19]

Judkins

[11] Patent Number: 6,148,894

[45] Date of Patent: Nov. 21, 2000

[54] HEADRAIL HAVING REVERSIBLE MODULAR CONTROLS

[76] Inventor: Ren Judkins, 46 Newgate Rd., Pittsburgh, Pa. 15202

[21] Appl. No.: 09/494,274

[22] Filed: Jan. 31, 2000

[51] Int. Cl.[7] ..... E06B 9/38

[52] U.S. Cl. ..... 160/177 R; 160/178.2 R

[58] Field of Search ..... 160/177 R, 178.2 R, 160/168.1 R, 177 V, 168.1 V, 172 R, 173 R, 178.1 R, 319, 321

[56] References Cited

U.S. PATENT DOCUMENTS

| | | | |
|---|---|---|---|
| 2,409,943 | 10/1946 | Kwon . | |
| 4,643,238 | 2/1987 | Tachikawa et al. . | |
| 4,646,808 | 3/1987 | Anderson | 160/178.2 R |
| 4,660,612 | 4/1987 | Anderson | 160/173 R |
| 4,667,723 | 5/1987 | Spangenberg | 160/178.2 R |
| 4,754,796 | 7/1988 | Ciriaci . | |
| 5,092,389 | 3/1992 | Tedeschi | 160/321 |
| 5,156,196 | 10/1992 | Corey et al. | 160/168.1 R X |
| 5,263,528 | 11/1993 | Patel | 160/178.2 R |
| 5,573,051 | 11/1996 | Judkins . | |

*Primary Examiner*—David M. Purol
*Attorney, Agent, or Firm*—Buchanan Ingersoll, P.C.

[57] ABSTRACT

A headrail for a venetian type blind has reversible modular controls that can be easily switched from the right side of the blind to the left side of the blind or vice versa by the installer. The headrail has an elongated body having a base, a first sidewall and a second sidewall. The first and second sidewalls are spaced apart, generally parallel and attached to the base. Each sidewall has a slot sized to receive a plug or a fitting through which the lift cords and tilt cords or hook for a tilt wand pass. The slots are opposite one another and of a same size. One changes the controls from one end of the headrail to the opposite end of the headrail by moving the lift cords and tilt cord or hook from one slot to the other slot.

20 Claims, 4 Drawing Sheets

FIG. 2
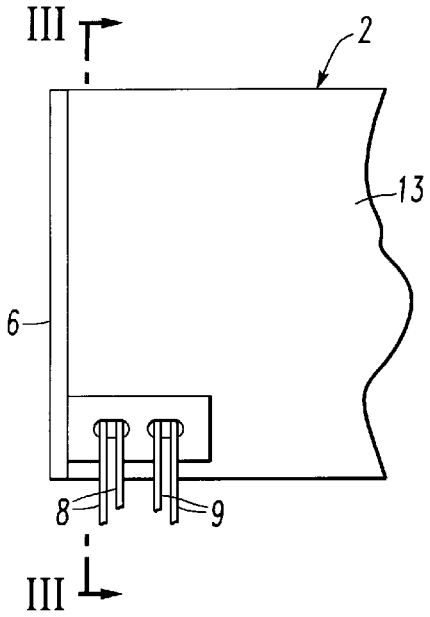
FIG. 3
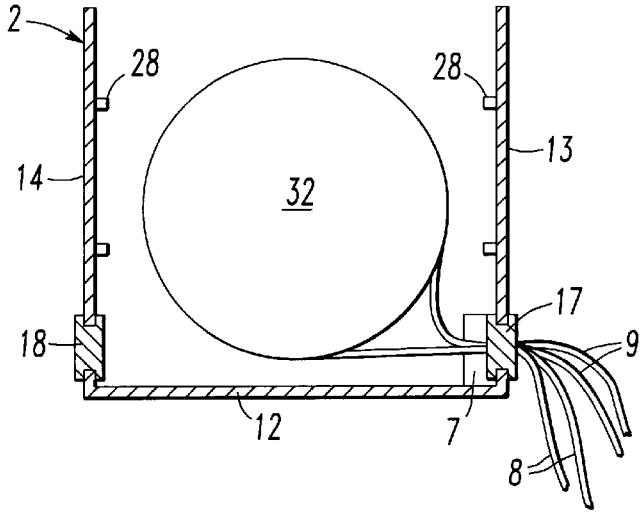
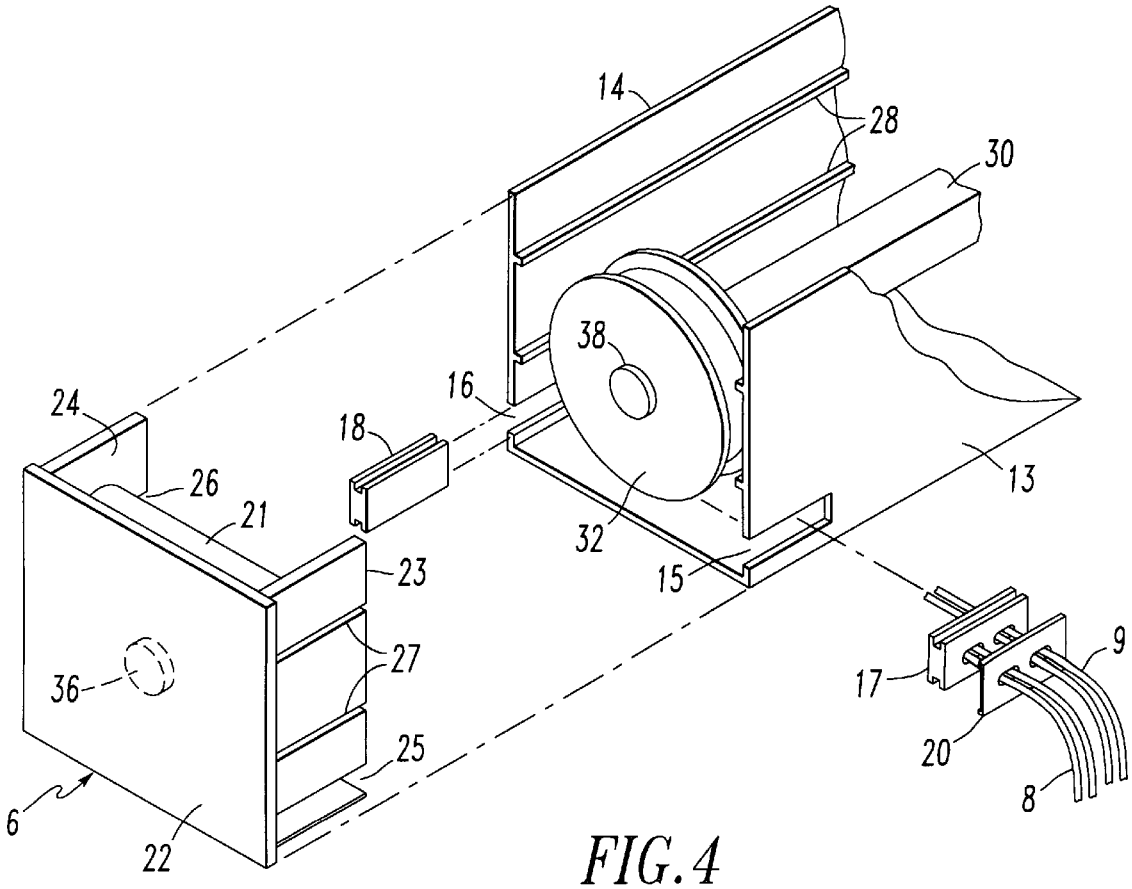
FIG. 4

HEADRAIL HAVING REVERSIBLE MODULAR CONTROLS

FIELD OF INVENTION

The invention relates to a headrail for venetian type blinds in which lift cords extend from the headrail and are used to raise and lower the blind.

BACKGROUND OF THE INVENTION

Venetian type blinds have a series of slats hung on ladders that extend from a headrail to a bottomrail. In most venetian blinds a pair of lift cords is provided, each lift cord having one end attached to the bottomrail and then passing through elongated holes in the slats up to and through the headrail. Alternatively, the lift cords may pass through slots in the edges of the slats as shown in U.S. Pat. No. 5,573,051. A cord lock is usually provided in the headrail through which the lift cords pass. The cord lock allows the user to maintain the blind in any desired position from fully raised to fully lowered. Many pleated, cellular and roman shades have a similar lift system in which lift cords extend from a bottomrail behind or through the pleated fabric and through a cord lock in the headrail.

The ladders in a venetian blind are attached to a tilt mechanism within the headrail. Frequently, the tilt mechanism includes a set of drums, one ladder attached to each drum and all drums carried on a shaft. A pair of tilt cords, a cord loop or a tilt wand is connected to the shaft. Pulling a tilt cord or turning a tilt wand turns the shaft and attached drums. This causes the rails of each ladder to move in opposite directions relative to one another thereby tilting the slats.

In a venetian blind the lift cord and tilt cords or tilt mechanism exit the headrail through the front rather than the bottom of the headrail so as not to interfere with the slats. It is common in the art to provide the tilt cords at one end of the headrail and the lift cords at the opposite end of the headrail as is disclosed in U.S. Pat. No. 2,409,943 to Kwon. The art has also positioned the tilt cords and lift cords at the same end of the headrail as disclosed in U.S. Pat. No. 4,643,238 to Tachikawa et al. During fabrication a hole is punched in the front of the blind to provide an opening for the lift cords and tilt cords. After that occurs the headrail is not symmetrical.

Nearly all blinds and pleated shades are fabricated in a factory and taken in finished form to the house or building where they will be hung by the an installer. Custom blinds, as well as nearly all blinds installed at a business location whether stock or custom, are almost always hung by a professional installer. The installer mounts the brackets that hold the blind at each window location and may adjust the length of the blind at the time of installation. The salesman is supposed to ask the buyer if he or she has a preference as to whether the lift cords and tilt cords should be on the right side or the left side of the blind. If a there is a preference the factory is supposed to be notified so that the blind is fabricated according to the customer's preference. This preference must be communicated from installer to salesman to customer service to factory personnel to inspection and is not only costly, but creates a potential for error. If the installer delivers a conventional blind with the controls on the wrong side, he cannot change the location of the blind controls in the field and must return that blind to the factory. Although some installers have the skills and the tools to fabricate blinds in their shop they seldom reconfigure blinds in their shop to change the position of the controls because that is a time consuming process. It is easier and less costly for the installer to simply return the blind to the factory. At least one manufacturer has reported that blinds have been returned because the controls were on the wrong side. Since large manufacturers sell hundreds of thousands of venetian blinds and pleated shades per year these returns are believed to amount to thousands of blinds being returned each year. Each return means that the installer must make a second trip to the home or business thereby increasing the cost of the sale to both the manufacturer and the installer. Furthermore, if an installer is required to return to a home to replace a blind, very often the customer will ask the installer to make other changes or adjustments. Then the installer must spend even more time on that sale. Consequently, there is a need for a headrail for venetian blinds and pleated shades in which the installer can change the position of the controls from one end of the headrail to the opposite end of the headrail in the field where the window covering is being installed.

SUMMARY OF THE INVENTION

I provide a headrail for venetian type blinds that has reversible modular controls that can be easily switched form the right side of the blind to the left side of the blind or vice versa. The headrail has an elongated, symmetrical body having a base, a first sidewall and a second sidewall both attached to the base. The first and second sidewalls are spaced apart and generally perpendicular to the base. Each sidewall has a slot sized to receive a plug or a fitting through which the lift cords and tilt cords or hook for a tilt wand pass. The slots are opposite one another and of a same size. One changes the controls from one end of the headrail to the opposite end of the headrail by moving the lift cords and tilt cord or hook from one slot to the other slot. This will also cause the sidewall that was originally the front of the headrail to become the back of the headrail and the sidewall that was originally the back of the headrail to become the front of the headrail.

Other objects and advantages of the present invention will become apparent from a description of the present preferred embodiments shown in the drawings.

BRIEF DESCRIPTION OF THE FIGURES

FIG. 2 is a front view of one end of a first present preferred headrail.

FIG. 3 is a sectional view taken along the line III—III of FIG. 2.

FIG. 4 is an exploded view of the end of the headrail shown in FIG. 2.

DESCRIPTION OF THE PREFERRED EMBODIMENTS

Figure 1:
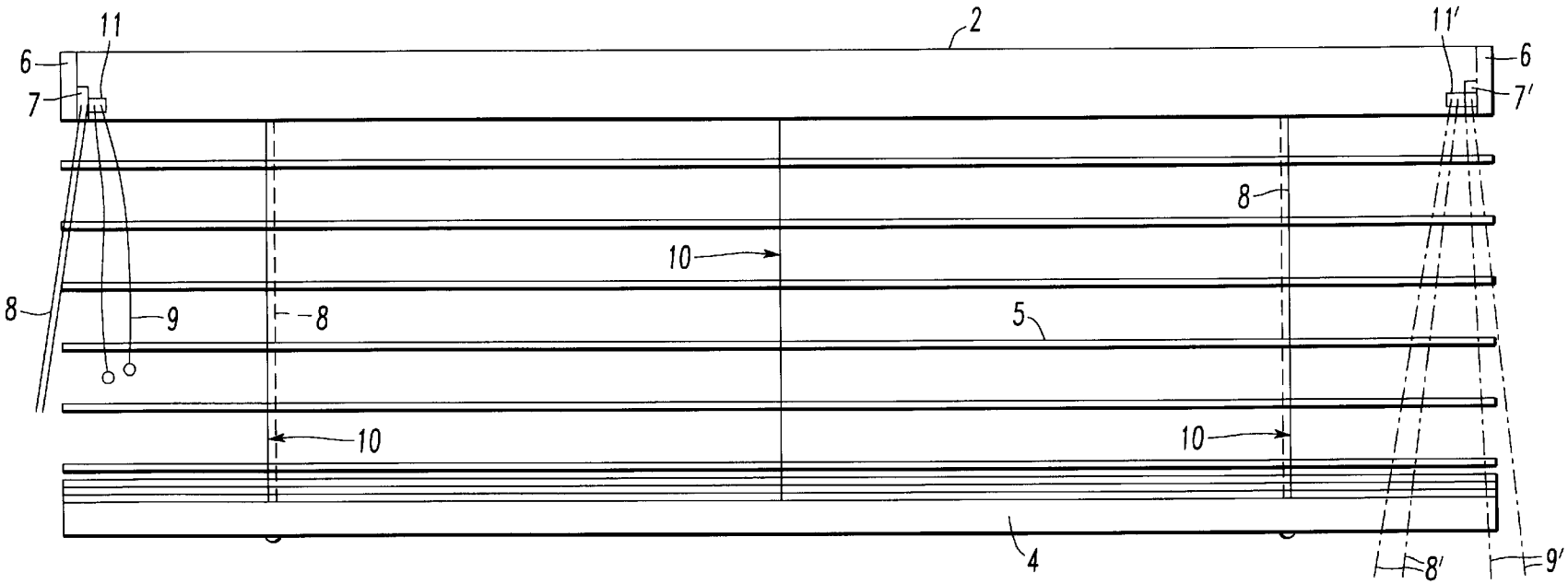
FIG. 1 is a front view of a venetian type blind shown in a lowered open positioned with an alternative position for the lift cord and tilt cord shown in chainline.

As shown in FIG. 1, a venetian blind is comprised of a headrail 2, a bottomrail 4 and set of slats 5 extending therebetween. End caps 6 are attached to the ends of the headrail. For purposes of illustration only six slats are shown. However, the blind could have any number of slats and likely would have many more slats than are shown. The slats are suspended on cord type ladders 10. Each ladder has a front rail, rear rail and series of rungs extending therebetween on which these slats rest. The bottom ends of the ladders are attached to the bottomrail 4. Lift cords 8 pass from the bottomrail into and through the headrail. The lift cords may pass through holes in the slats or may pass through slots in the edges of the slats. Tilt ladders 10 are positioned near the ends of the blind so that the rails are adjacent the lift cords. A third tilt ladder is provided at the center of the blind where no lift cords are needed. For purposes of illustration the lift cords 8 are shown in chain line in FIG. 1 so as to distinguish them from the adjacent rails of the tilt ladders.

The number of lift cords that are used will vary according to the size of the blind and the cording arrangement. In the cording arrangement used in the blind of FIG. 1 lift cords are positioned near either end of the blind. The lift cords 8 extend from the bottomrail, run through or adjacent the slats, enter the headrail and pass through cord lock 7 on the left side of the blind. The tilt cords 9 pass through a fitting 11 that is adjacent the cord lock. If desired the positions of the cord lock 7 and the fitting 11 could be reversed. In another cording arrangement the lift cords and tilt cords would exit the headrail on the right side of the blind as indicated by cord lock 7', lift cords 8', tilt cords 9' and fitting 11' shown in chainline in FIG. 1. In the alternative cording arrangement shown in chainline the cord lock 7' is shown inboard of the tilt cords 9'.

Figure 5:
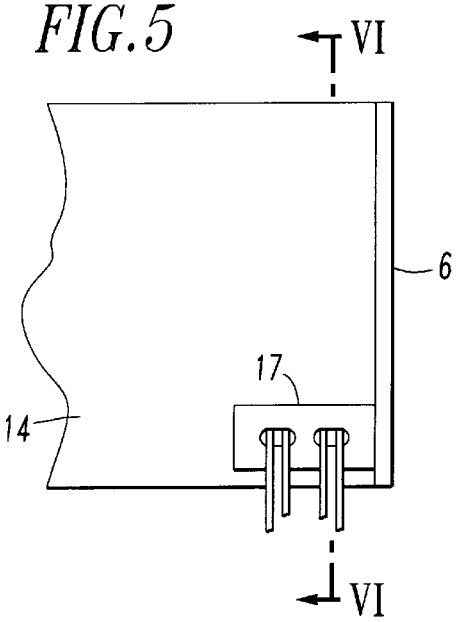
FIG. 5 is front view of the same end of the headrail shown in FIG. 2 after the controls have been reversed.
Figure 6:
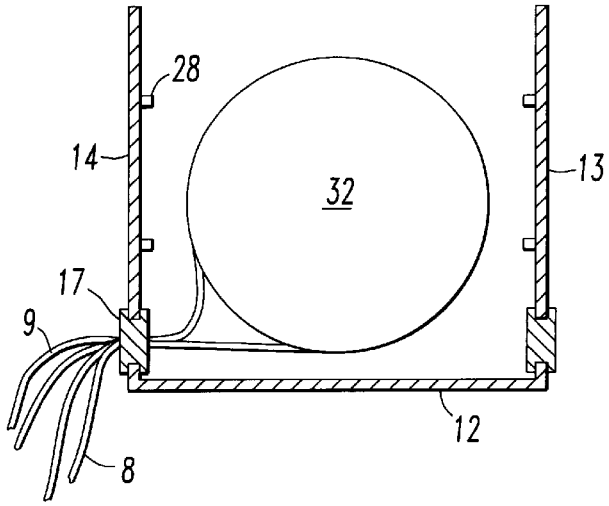
FIG. 6 is a sectional view taken along the line VI—VI of FIG. 5.
Figure 7:
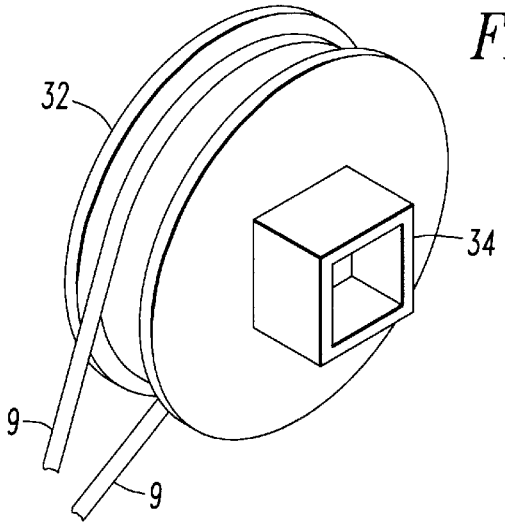
FIG. 7 is a rear perspective view of the spool in the first present preferred embodiment.

In a first preferred embodiment shown in FIGS. 2 through 7, I provide a headrail 2 having a base 12, a first wall 13 and a second wall 14. In this embodiment the cord lock 7 is inside the headrail. When configured as shown in FIGS. 2 through 4, the first wall 13 is the front of the headrail. However, when configured as shown in FIGS. 5 and 6, by reversing the blind, putting the backside of the headrail on the front side and switching the control from front to back, the first wall 13 is the rear or back of the headrail. A slot 15 is provided in one end of the first wall 13 and a similar slot 16 is provided in one end of the second wall 14. Both slots 15 and 16 are identical in size and shape. In the configuration of FIGS. 2 through 4 a plug 18 is placed in slot 16 and a fitting 17 is placed in slot 15. The fitting has route holes through which the lift cords and tilt cords pass. Although the cord lock 7 is a separate component in this embodiment, the cord lock could be part of the fitting or attached to the tilter. I also prefer to provide a cover 20 that snaps onto the fitting 17. This cover 20 is the same color as the headrail. Consequently, a manufacturer can make one fitting 17 that can be used for all colors of blinds. The cover 20 may be made of the same plastic as the endcaps 6 and made in the same mold. The end cap 6 has a base 22 having a front and a back. Sidewalls 23 and 24 extend from the back. The sidewalls each have a slot 25 or 26 that will be aligned with slot 15 or 16 in the walls 13 and 14 of the headrail when the endcap is placed on the headrail. These slots are large enough to accommodate the plug 18 or fitting 17. Grooves 27 are provided in the outer faces of the sidewalls 23 and 24 to receive tracks 28 on the inside surface of the first wall 13 and the second wall 14. A cover wall 21 is provided on the endcap which surrounds the tilt spool 32.

Referring to FIG. 4, there is an axle 30 within the headrail that extends from the tilt spool 32 and carries the drums (not shown) to which the ladders are attached. This axle is supported by cradles (not shown) within the headrail. A hub 34 extends from the center of the tilt spool 32 and is configured to receive and grip the axle 30. Consequently, when the tilt spool is turned the axle 30 will rotate in the same direction. The endcap 6 has a post 36 that fits into cavity 38 in the tilt spool when the endcap is on the headrail to prevent the tilt spool from moving laterally. This post supports the tilt drum 32 and aligns the tilt drum 32 with the tilt axle 30. When the first present preferred embodiment is configured as shown in FIGS. 2, 3 and 4 the tilt cords and the lift cords will be on the left side of the blind. Should a customer tell the installer that the controls should be on the right side of the blind it is easy for the installer to make that change. He simply removes the endcap 6 as well as plug 18 and fitting 17 with cover 20. Then he places plug 18 in slot 15. Although it is not necessary to do so, the installer may switch the lift cords and the tilt cords so that they pass through different holes in the fitting 17 and cover 20. Then he places the fitting 17 in slot 16 to produce the configuration shown in FIG. 6. An important feature of the present embodiment is that the cords do not need to be retied or repositioned when the position of the controls are changed. Consequently, that change can be made quickly and requires minimal skill and training. It may or may not be necessary to reposition the cord lock 7. If the cord lock is secured to the first wall 13 or the fitting 17 it will be necessary to move the cord lock to a position near the second wall. However, the cord lock may be positioned at a distance from the fitting and slots so that it need not be moved. To complete the change, the installer replaces the endcap 6 onto the headrail 2 and the controls are now on the right side of the blind as shown in FIG. 5. It should also be apparent that the second wall 14 of the headrail 2 is now the front of the headrail.

Figure 8:
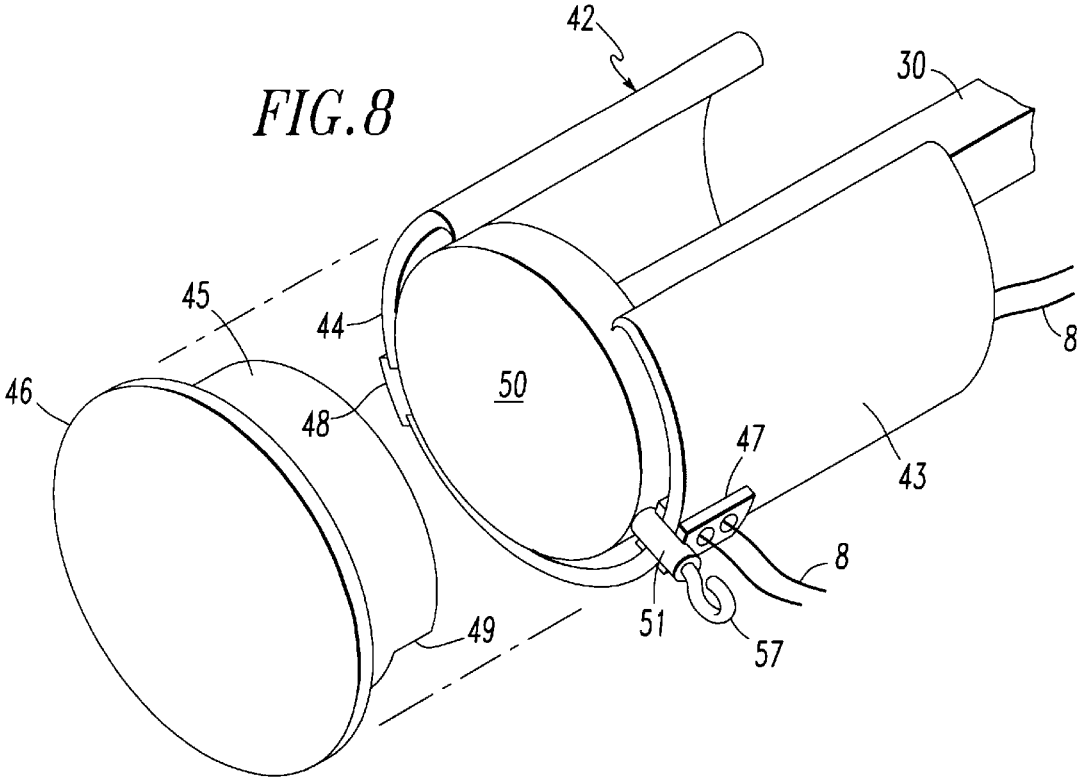
FIG. 8 is an exploded view similar to FIG. 4 of a second present preferred embodiment of the invention.
Figure 9:
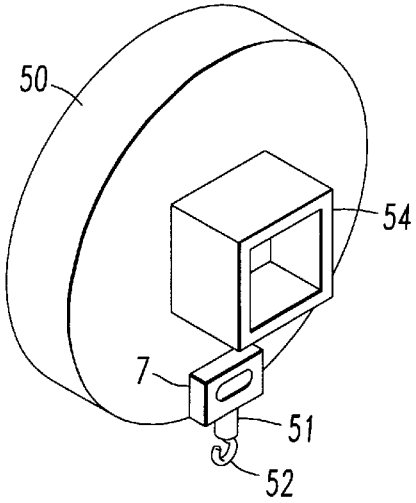
FIG. 9 is a rear prospective view of the tilter in the embodiment of FIG. 8.
Figure 10:
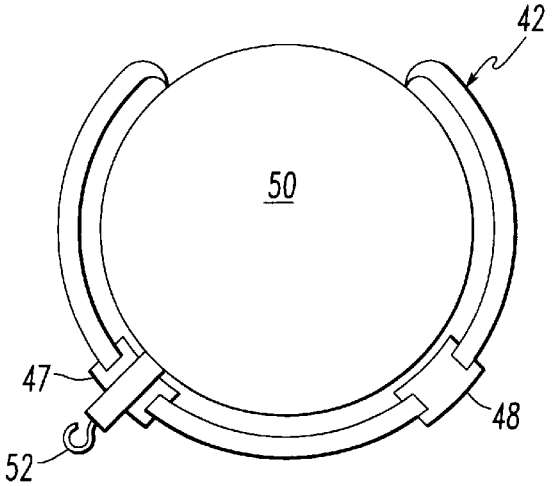
FIG. 10 is an end view of the headrail shown in FIG. 8 with the end cap removed and after the positions of the plug and the fitting have been switched.

A second present preferred embodiment shown in FIG. 8 has a headrail 42 having a generally circular or oval cross section. As in the first embodiment there is an axle 30 that extends through the headrail and carries the drums that hold the ladders. Lift cords 8 pass though the headrail and through a cord lock (not shown) that is located behind fitting 47 through which the lift cords exit the headrail. This embodiment has a wand type tilter 50. This tilter 50 has a hook 52 that extends from the tilter through the headrail. A wand (not shown) is attached to the hook. Turning the wand turns the hook. That hook 52 is connected to gears within the tilter that cause hub 54 to turn. Consequently, turning the wand will turn axle 30, which is held by hub 54, will turn. A cord lock 7 is attached to the tilter 50. In this embodiment the slots, which hold the fitting 47 and the plug 48, are at approximately the 5:00 and 7:00 position. Hence, one could consider that portion 43 of the headrail 42 that is above a line running below the fitting 47 to be the first wall. That portion of the headrail 44 that is above a line running below the plug 48 can be viewed as the second wall. When the fitting is in a slot in the first wall as shown in FIG. 8 the controls will be on the left side of the blind. To change the controls to the right side of the blind one removes the endcap 46 as well as plug 48 and fitting 47. He also removes the tilter 50. Then he places plug 48 in the slot in the first wall 43. Next he places the fitting 47 in the slot in the second wall 44. Then he repositions the tilter 32 on the end of axle 30 to produce the configuration shown in FIG. 6. Finally, he replaces the endcap 46 onto the headrail 2 and the controls are now on the right side of the blind. Now the second wall 44 of the headrail 2 is the front of the headrail. Because the tilter is modular it is easy to move the hook from the 5:00 position to the 7:00 position as shown in FIGS. 8 and 10. One simply rotates the tilt mechanism about an axis through its center. Then the stem 51 and cord lock 7 will rotate from a position adjacent one slot to a position adjacent the other slot. The endcap 46 for this embodiment is similar to the endcap 6 of the first embodiment. A sidewall 45 extends from the base of the endcap and has slots to accommodate the fitting 47 and plug 48. Tilter 50 is symmetrical and modular. The stem 51 prevents the tilter from rotating once it is in place.

While the present preferred embodiments are designed for venetian blinds, those skilled in the art will recognize that the headrail could also be used for any shades lifted with cords. When so used there would be no tilt mechanism and only lift cords would extend through the slats.

Although I have shown certain present preferred embodiments of my headrail it should be distinctly understood that the invention is not limited thereto, but may be variously embodied within the scope of the following claims.

I claim:

1. A headrail comprising:

a. an elongated body having a base, a first sidewall and a second side wall, the first and second sidewalls being spaced apart and attached to the base, each sidewall having a first end and a second end wherein there is a first slot in the first end of the first sidewall and a second slot in the first end of the second sidewall, the first slot and the second slot being opposite one another and of a same size;

b. a plug positioned in one of the first slot and the second slot;

c. a fitting positioned in the other of the first slot and the second slot the fitting having at least one aperture through which a lift cord can pass; and d. an endcap attached to the first end of the first sidewall and the first end of the second sidewall.

2. The headrail of claim 1 also comprising a cord lock attached to the headrail.

3. The headrail of claim 1 also comprising a tilt mechanism within the headrail.

4. The headrail of claim 3 wherein the tilt mechanism is a wand type tilter.

5. The headrail of claim 4 wherein the wand type tilter has a stem sized and positioned to fit through the first slot and the second slot and the tilter is configured so that one can move the stem from the first slot to the second slot by rotating the tilter.

6. The headrail of claim 3 wherein the tilt mechanism is a cord type tilter.

7. The headrail of claim 1 also comprising a cord lock attached to the tilt mechanism.

8. The headrail of claim 1 also comprising a cover attached to the fitting.

9. The headrail of claim 8 wherein the cover and the endcaps are a same color.

10. The headrail of claim 1 wherein the side walls are parallel to one another.

11. The headrail of claim 1 wherein the fitting also comprises a cord lock.

12. The headrail of claim 1 wherein the fitting is configured to allow passage of at least one of a portion of a tilter and a tilt cord through the fitting.

13. A venetian blind comprised of a headrail, a bottomrail, a plurality of slats positioned on ladders extending from the bottomrail into the headrail and lift cords extending from the headrail to the bottomrail wherein the headrail comprises:

a. an elongated body having a base, a first sidewall and a second side wall, the first and second sidewalls being spaced apart and attached to the base, each sidewall having a first end and a second end wherein there is a first slot in the first end of the first sidewall and a second slot in the first end of the second sidewall, the first slot and the second slot being opposite one another and of a same size;

b. a plug positioned in one of the first slot and the second slot;

c. a fitting positioned in the other of the first slot and the second slot the fitting having at least one aperture through which a lift cord can pass and configured to allow passage of at least one of a portion of a tilter and tilt cord through the fitting; and d. an endcap attached to the first end of the first sidewall and the first end of the second sidewall.

14. The venetian blind of claim 13 also comprising a tilt mechanism connected to the tilt axle.

15. The venetian blind of claim 13 wherein the tilt mechanism is a wand type tilter.

16. The venetian blind of claim 13 wherein the tilt mechanism is a cord type tilter.

17. The venetian blind of claim 13 also comprising a cover attached to the fitting.

18. The venetian blind of claim 17 wherein the cover and the endcaps are a same color.

19. The venetian blind of claim 13 wherein the side walls are parallel to one another.

20. The venetian blind of claim 13 wherein the fitting also comprises a cord lock.

* * * * *